United States Patent [19]

Moeller

[11] 4,254,727

[45] Mar. 10, 1981

[54] SHOCK-CRUSH SUBFOUNDATION

[76] Inventor: Kurt G. F. Moeller, R.F.D. #3, Harness Creek Rd., Annapolis, Md. 21403

[21] Appl. No.: 863,053

[22] Filed: Dec. 30, 1959

[51] Int. Cl.[3] ..... B63B 3/00

[52] U.S. Cl. ..... 114/65 R

[58] Field of Search ... 114/65, 66.5 P, 67 (U.S. only), 114/74 A, 17, 13, 66.5; 267/64, 65, 64 A, 65 A, 67; 248/24, 356, 20, 21, 22

[56] References Cited

U.S. PATENT DOCUMENTS

| | | | |
|---|---|---|---|
| 1,236,033 | 8/1917 | Almengual | 114/13 |
| 1,262,346 | 4/1918 | Hough | 114/13 |
| 1,593,231 | 7/1926 | White | 431/168 |
| 2,135,394 | 11/1938 | Geissen | 114/65 R |
| 2,283,484 | 5/1942 | Bak | 114/13 |
| 2,359,915 | 10/1944 | Hussman | 248/562 |
| 2,390,300 | 12/1945 | Harris | 114/45 |
| 2,639,913 | 5/1953 | Reynolds | 267/128 |
| 2,712,913 | 7/1955 | Stanley | 455/273 |
| 2,746,414 | 5/1956 | Roberts | 114/298 |
| 2,776,637 | 1/1957 | Chadwick | 114/77 R |
| 2,967,739 | 1/1961 | Hoffmann | 267/122 |

FOREIGN PATENT DOCUMENTS

| | | | |
|---|---|---|---|
| 595163 | 7/1925 | France | 114/66.5 P |

*Primary Examiner*—David H. Brown

*Attorney, Agent, or Firm*—R. S. Sciascia; L. A. Marsh

EXEMPLARY CLAIM

2. A shock crushable subfoundation comprising a base, a frame member reinforcing said base, an equipment support member, and deformation absorbing means interposed between said frame member and said equipment support member, said means including a universal joint connected to one of a pair of concentric cylinders joined in overlapping relationship by a press fit, whereby said deformation absorbing means are enabled to absorb plastic deformation of said base and said frame member.

13 Claims, 4 Drawing Figures

SHOCK-CRUSH SUBFOUNDATION

The invention described herein may be manufactured and used by or for the Government of the United States of America for governmental purposes without the payment of any royalties thereon or therefor.

The present invention relates to a shock-crush subfoundation and more particularly to a shock-crush subfoundation for preventing hull deformation caused by underwater explosions or other forces from affecting the alignment of internal structures, particularly machinery foundations.

In general, an ocean-going ship, whether it be surface ship or submarine, can take a great deal of damage resulting in deformation of the hull geometry without losing its water-tight integrity. However, such damage without rupture usually affects the internal installations to such an extent that most of the machinery in the inflicted area becomes inoperable. This may render the ship dead in the water, but afloat, presenting a very undesirable discrepancy between resistance of the hull and that of the machinery; the ship should be operable as long as it is afloat.

Conventional ship construction, aimed at taking protective action against the effects of shock accelerations, utilizes members of sufficient structural strength in conjunction with shock absorbers and/or crushable intermediate layers of corrugated steel. Shock absorbers can be utilized effectively with deformations up to about one inch. Corrugated steel for sufficient structural strength is also practically limited to deformations up to about one inch. Corrugated steel also has the disadvantage that it is effective for but one blow after which it must be replaced since it has been flattened and is of no further use in protection against future damage.

Experience has indicated that hull deformations of about ten inches may be experienced in some instances without rupture. Therefore, in spite of the fact that the ship remains afloat, it is often not operable because the deformation of the hull has caused misalignment of propulsion machinery or other gear necessary for the ship's operation.

This application is related to copending application Ser. No. 858,827, Navy Case No. 26,940, filed Dec. 10, 1959, entitled Shock Crush Sub-foundation, and is an improvement thereon. In the copending application there is described a type of hull construction designed to absorb large hull deformations without causing misalignment of machinery mounted thereon. This is accomplished by introducing a danger zone into the internal design of the ship encompassing a space or layer of predetermined thickness equal to the maximum deflection of the particular hull without causing rupture. The danger zone is bridged by special members which are able to follow the deformation without losing their static load carrying ability.

This configuration is a great improvement over other known devices but it was found that any deformation which occurred at an angle to the axis of the deformable member could not readily be accommodated.

The present invention utilizes the principles set forth in the copending application referred to above, but in addition to the elements set forth therein includes a series of universal joints which allow three dimensional deformation without endangering the machinery mounted thereon.

It is therefore an object of this invention to provide an improved machinery subfoundation for ships.

Another ojbect is the provision of a machinery subfoundation which will allow maximum hull deformation without causing misalignment of the machinery.

A further object is to provide a machinery subfoundation capable of absorbing three dimensional deformation.

Other objects and many of the attendant advantages of this invention will be readily appreciated as the same becomes better understood by reference to the following detailed description when considered in connection with the accompanying drawings wherein.

Figure 1:
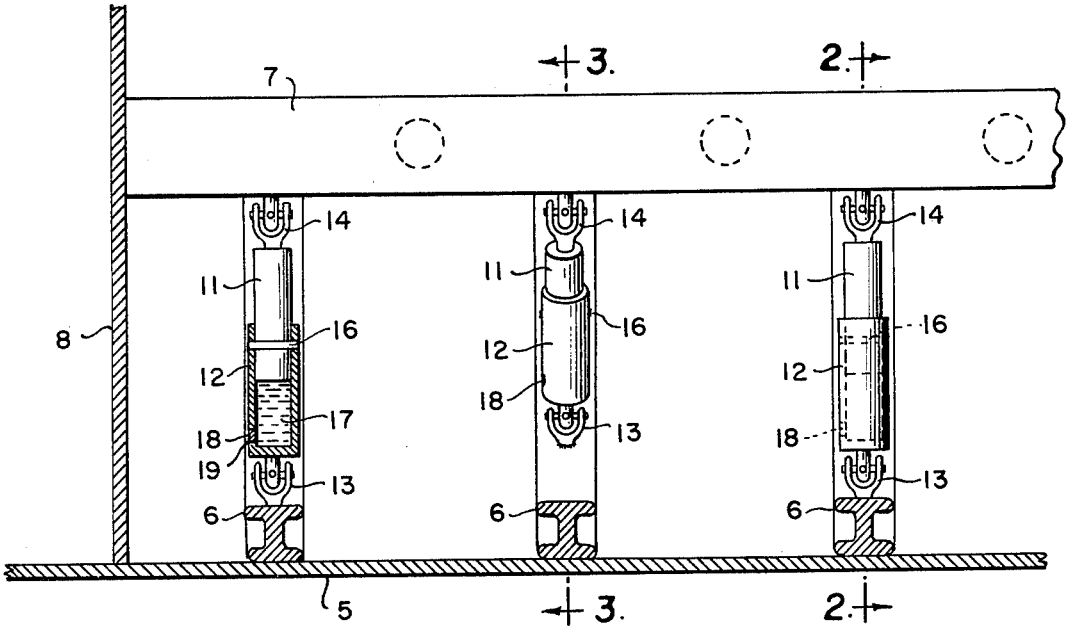
FIG. 1 is a plan view, partly in section, showing an embodiment of this invention.
Figure 2:
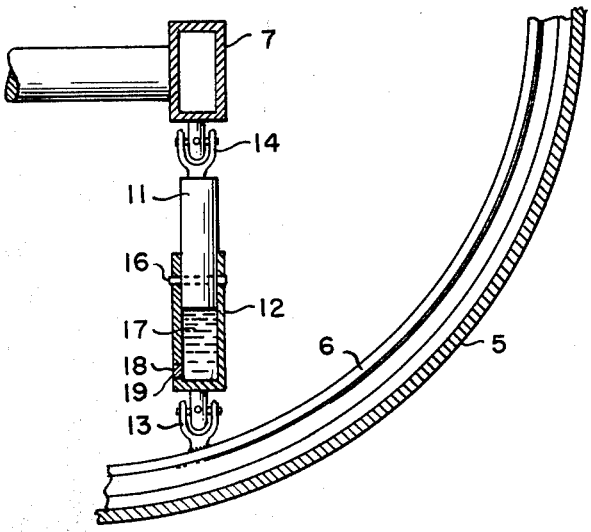
FIG. 2 is a sectional view taken on the line 2—2 of FIG. 1.
Figure 3:
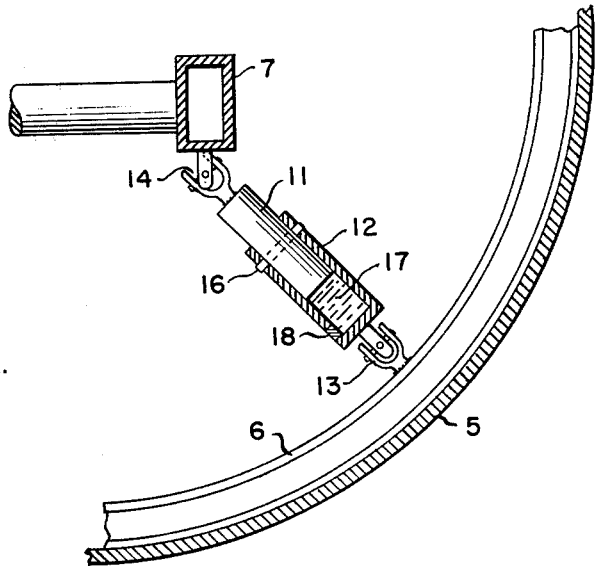
FIG. 3 is a sectional view taken on line 3—3 of FIG. 1.

Referring now to the drawings wherein like reference characters designate like or corresponding parts throughout the several views, there is shown in FIG. 1 a hull 5 which may be either the hull of a surface ship or the pressure hull of a submarine. Reinforcing the hull 5 are a plurality of frame members 6, which may be I-beams or the like, supporting a machinery foundation 7 which may extend between a pair of bulkheads, one being represented by plate 8 and the other not shown. As shown in the drawings, the machinery foundation may be composed of hollow rectangular members interconnected by tubular members. It will be realized that members of any shape may be used provided the structure has sufficient structural strength to carry the desired machinery. Supporting the machinery foundation 7 on the hull frame members 6, and interposed therebetween, are a plurality of telescoping members 11, 12 connected to the hull frame members by universal joints 13 and to the machinery foundation by second universal joints 14. The telescoping members are arranged alternately in vertical directions (FIG. 2) and at an angle of about 40 degrees (FIG. 3). By use of this arrangement any tendency of the universal joints to allow lateral shifting of the machinery foundation is minimized.

The telescoping members are arranged in a press fit relationship so that considerable force is required to cause them to telescope. As shown in FIG. 1, there is a shear pin 16 passing through both cylinders and a body of viscous fluid 17 in the enclosed space between the two telescoping members 11 and 12. An aperture or orifice 18 covered by a diaphragm 19 (see FIG. 5) is near the bottom of the larger of the two members.

It will be realized that a force acting on the hull and causing deformation will stress the structural members. The viscosity of the fluid in the cylinders, the size of the orifice, and the shear pin strength are chosen to discriminate between shock impacts of short duration and forces of longer duration. Impacts of short duration (order of $10^{-3}$ seconds) normally cause only elastic displacements and usually are not damaging to the machinery. Impacts of longer duration (order of $10^{-2}$ seconds or longer) cause plastic deformation and subsequent damage. For the short shock impact with its steep gradient, the viscous matter presents a hard resistive block; for stresses of greater duration, the diaphragm 19 ruptures causing the fluid 17 to flow from aperture 18 and the shear pin 16 is allowed to shear. The cylinders telescope into each other by an amount according to the force exerted on them. Thus by proper choice of the forces required to shear the bolt and the force required to force the cylinders together as well as proper choice of the fluid viscosity and orifice size, it is possible to design a force-displacement-time diagram of the hull portion involved.

Figure 4:
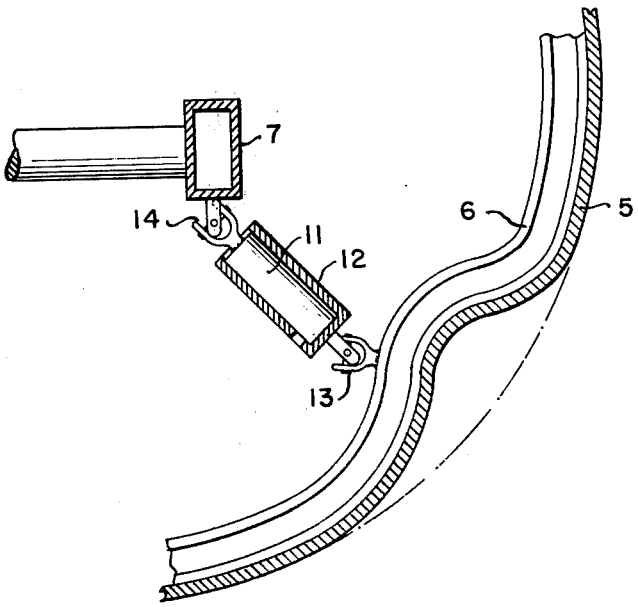
FIG. 4 is a view of FIG. 3 showing the device after deformation.

FIG. 4 illustrates a portion of the hull that has been damaged by a severe blow. As can be seen in the Fig., the shear pin 16 has been sheared, the diaphram ruptured, and the fluid forced from member 12.

Members 11 and 12 have been forced together and the angle at which the device is arranged has been altered. It will be realized that a three dimensional displacement of the telescoping device is possible from any given blow. If the telescoping members were rigidly mounted between the machinery foundation and the hull support members, any force parallel to the axis of the telescoping members could be absorbed by the telescoping members, but any forces acting at an angle to the axis would exert a bending or shearing moment on the telescoping members. If the bending or shearing forces are sufficient to cause bending or breakage of the shock absorbing elements, telescoping becomes impossible and the movement is transmitted to the machinery foundation. For this reason, universal joints 13 and 14 have been provided for connecting the telescoping members to the frame members and the machinery support members. The universal joints allow the telescoping members to shift in two dimensions while the telescoping members absorb movement in the third dimension, so that three dimensional deformation may be absorbed without danger to the machinery.

The specific form of universal joint to be used must be chosen in accordance with the particular design of the ship. In some cases a pin joint may be sufficient while in other cases an hourglass pin joint or true universal joint may be necessary. The joints are designed to have compliance only above a certain force limit so that they have no tendency to shift except when a certain minimum force, surpassing the static force of the machinery weight and normal operating forces, is applied. This may be accomplished by clamping the joint rigidly in position; the clamp being designed to release upon application of a predetermined load. The joint is also designed to have high friction to allow movement only upon application of relatively large loads in accordance with the design of the particular ship on which it is to be used. It will be realized that either the aforedescribed clamping arrangement or the joint friction or a combination of both may be relied on as the means for rigidly holding the joint against movement until a predetermined force is exerted thereon. Thus under normal operating conditions the joint acts as a fixed support.

Although a particular configuration of the shock absorbing mount has been described it will be readily seen by those skilled in the art that various configurations utilizing the principles herein described may be utilized. The normal angles at which the shock absorbing members are mounted may be varied considerably. The invention, although described in conjunction with a ship hull, is not limited thereto. The reservoir of fluid and/or the shear pin may be omitted; the press fit between the telescoping elements being solely relied on to provide proper shock absorbency.

It will be obvious to those skilled in the art that the absorption of deformation by the crushable members will result in a high probability of keeping the propulsion and other vital machinery mounted on the foundation in operation as long as the hull of the ship remains afloat. This will reduce considerably the possible losses of ships.

Another inherent advantage of the subfoundation principle herein disclosed is the high mechanical impedance provided which warrants a high degree of effectiveness for noise isolation mounts inserted between the foundation and the machinery. These are usually applied to reduce the noise transmission from the machinery into the water and it is of particular significance that the subfoundation has suitable criteria not only for shock protection, but also for noise control.

Obviously many modifications and variations of the present invention are possible in the light of the above teachings. It is therefore to be understood that within the scope of the appended claims the invention may be practiced otherwise than as specifically described.

What is claimed is:

1. A shock crushable subfoundation comprising a base, a frame member reinforcing said base, an equipment support member, and deformation absorbing means interposed between said frame member and said equipment support member for absorbing plastic deformation of said base and said frame member to prevent deformation of said support member, said means including a universal joint connected to a hollow member containing viscous fluid and having an orifice therein, and a diaphragm, said diaphragm normally sealing said orifice but being designed to rupture upon plastic deformation of said base member and said frame member.

2. A shock crushable subfoundation comprising a base, a frame member reinforcing said base, an equipment support member, and deformation absorbing means interposed between said frame member and said equipment support member, said means including a universal joint connected to one of a pair of concentric cylinders jointed in overlapping relationship by a press fit, whereby said deformation absorbing means are enabled to absorb plastic deformation of said base and said frame member.

3. The invention as defined in claim 2 and further including a shear pin passing through both of said concentric cylinders.

4. The invention as defined in claim 2 wherein said universal joint includes means for rigidly holding said joint against movement until a predetermined force is exerted thereon.

5. A shock crushable subfoundation comprising a ship hull, a frame member reinforcing said hull, a machinery support member, and deformation absorbing means interposed between said frame member and said machinery support member, said means including a universal joint connected to a hollow member containing viscous fluid and having an orifice therein, and a diaphragm, said diaphragm normally sealing said orifice but being designed to rupture upon plastic deformation of said hull and said frame member.

6. A shock crushable subfoundation comprising a ship hull, a frame member reinforcing said hull, a machinery support member, and deformation absorbing means interposed between said frame member and said equipment support member, said means including a universal joint connected to one of a pair of concentric cylinders joined in overlapping relationship by a press fit, whereby said deformation absorbing means are enabled to absorb plastic deformation of said hull and said frame member.

7. The invention as defined in claim 6 and further including a shear bolt passing through both said concentric cylinders.

8. The invention as defined in claim 6, wherein said universal joint includes means for rigidly holding said joint against movement unitl a predetermined force is exerted thereon.

9. A shock crushable subfoundation comprising a base, a frame member reinforcing said base, a first universal joint having one end thereof fixedly connected to said frame member and the opposite end thereof fixedly connected to a hollow member containing viscous fluid and having an orifice therein, a diaphragm, said diaphragm normally sealing said orifice but being designed to rupture upon application of a predetermined force on said fluid, a second universal joint having one end fixedly connected to said hollow member, and an equipment support member fixedly mounted on the other end of said second universal joint.

10. The invention as defined in claim 9 wherein means are provided for rigidly holding each of said universal joints against movement until a predetermined force is exerted thereon.

11. The invention as defined in claim 9 wherein said hollow member comprises a pair of concentric cylinders joined in overlapping relationship by a press fit.

12. The invention as defined in claim 11 wherein means are provided for rigidly holding each of said universal joints against movement until a predetermined force is applied.

13. The invention as defined in claim 11 and further including a shear bolt passing through both said concentric cylinders.

* * * * *